US009586728B2

(12) United States Patent
Kling

(10) Patent No.: US 9,586,728 B2
(45) Date of Patent: Mar. 7, 2017

(54) DISPENSING SYSTEM WITH THE MEANS FOR DETECTING LIQUID LEVEL AND A COLLAPSIBLE CONTAINER FOR SUCH A SYSTEM

(71) Applicant: SCA Hygiene Products AB, Göteborg (SE)

(72) Inventor: Robert Kling, Skene (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 14/437,512

(22) PCT Filed: Oct. 25, 2012

(86) PCT No.: PCT/SE2012/051155
§ 371 (c)(1),
(2) Date: Apr. 22, 2015

(87) PCT Pub. No.: WO2014/065728
PCT Pub. Date: May 1, 2014

(65) Prior Publication Data

US 2015/0274375 A1 Oct. 1, 2015

(51) Int. Cl.
*A47K 5/14* (2006.01)
*B65D 37/00* (2006.01)
(Continued)

(52) U.S. Cl.
CPC ..... *B65D 35/28* (2013.01); *A47K 5/1209* (2013.01); *A47K 5/1211* (2013.01);
(Continued)

(58) Field of Classification Search
CPC ..... A47K 5/12; A47K 5/1209; A47K 5/122; A47K 5/1215; A47K 5/1211; B65D 35/00; B65D 35/28; B65D 35/30; B65D 77/06
See application file for complete search history.

(56) References Cited

U.S. PATENT DOCUMENTS 4,570,823 A 2/1986 Arabian et al.
4,722,372 A * 2/1988 Hoffman ..... A47K 5/1209 137/562
(Continued)

FOREIGN PATENT DOCUMENTS

CN 2143948 Y 10/1993
CN 200971226 Y 11/2007
(Continued)

OTHER PUBLICATIONS

Australian Patent Examination Report No. 1 dated Dec. 3, 2015 issued in corresponding Australian patent application No. 2012393021 (4 pages).
(Continued)

*Primary Examiner* — Frederick C Nicolas
(74) *Attorney, Agent, or Firm* — Drinker Biddle & Reath LLP

(57) ABSTRACT

A dispensing system includes a collapsible container for liquid material, such as soap, with an outlet for withdrawal of liquid material during collapse thereof. The dispensing system includes a support structure configured for wall attachment of the dispensing system. The support structure further includes at least one movable follower biased towards a collapsing part of the collapsible container, and a detector for reading the position of the movable follower. Detectable substance can be added to the movable follower or the collapsible container. The detector can actuate an alert indicator for indicating a low level of liquid in the collaps-
(Continued)

ible container. Also a collapsible container with detectable substance is disclosed for use in such a system.

21 Claims, 6 Drawing Sheets

(51) Int. Cl.

| | |
|---|---|
| ***B65D 35/28*** | (2006.01) |
| *B65D 77/06* | (2006.01) |
| *B65D 35/00* | (2006.01) |
| *B65D 35/30* | (2006.01) |
| *A47K 5/12* | (2006.01) |
| *A47K 5/122* | (2006.01) |

(52) U.S. Cl.
CPC ..... *A47K 5/1215* (2013.01); *A47K 5/12* (2013.01); *A47K 5/122* (2013.01); *B65D 35/00* (2013.01); *B65D 35/30* (2013.01); *B65D 77/06* (2013.01)

(56) References Cited

U.S. PATENT DOCUMENTS

| | | | | |
|---|---|---|---|---|
| 4,932,562 | A | 6/1990 | Christine | |
| 4,976,851 | A * | 12/1990 | Tanokura | A61M 1/029 210/109 |
| 5,083,678 | A | 1/1992 | Waring | |
| 5,135,646 | A * | 8/1992 | Tanokura | A61M 1/029 210/109 |
| 5,221,050 | A * | 6/1993 | Jeffries | B05B 5/035 222/103 |
| 5,255,822 | A * | 10/1993 | Mease | A47K 5/1202 222/113 |
| 5,323,932 | A * | 6/1994 | Bauman | B65D 35/28 222/103 |
| 5,398,845 | A * | 3/1995 | Meyer | A45D 27/10 222/1 |
| 5,553,740 | A * | 9/1996 | King | B67D 1/0001 222/1 |
| 5,556,005 | A * | 9/1996 | Banks | A47K 5/1207 222/105 |
| 6,067,906 | A * | 5/2000 | Ryan | B41F 31/02 101/335 |
| 6,135,320 | A | 10/2000 | Parsons | |
| 6,325,244 | B2 * | 12/2001 | Vincent | 222/1 |
| 7,007,824 | B2 * | 3/2006 | Danby | B65D 77/30 222/103 |
| 7,681,760 | B2 * | 3/2010 | Sadamoto | H01M 8/04 222/103 |
| 8,690,018 | B2 | 4/2014 | van der Heijden et al. | |
| 2002/0122083 | A1 | 9/2002 | Hsu et al. | |
| 2004/0144799 | A1 * | 7/2004 | Danby | B65D 77/30 222/94 |
| 2008/0023487 | A1 | 1/2008 | Douwes | |
| 2008/0164287 | A1 * | 7/2008 | Larsson | B67D 7/04 222/333 |
| 2009/0302058 | A1 * | 12/2009 | D'Aguisto, II | B05C 17/00583 222/103 |
| 2012/0104020 | A1 * | 5/2012 | Cur et al. | B67D 1/0001 222/1 |
| 2014/0224835 | A1 * | 8/2014 | Tobler | B01F 5/061 222/94 |

FOREIGN PATENT DOCUMENTS

| | | | |
|---|---|---|---|
| CN | 102421346 | A | 4/2012 |
| DE | 9012878 | U1 | 11/1990 |
| EP | 0072783 | A1 | 2/1983 |
| EP | 2 058 233 | A2 | 5/2009 |
| EP | 2 447 640 | A2 | 5/2012 |
| GB | 2025515 | A | 1/1980 |
| SU | 41141 | A1 | 1/1935 |
| WO | WO-94/15515 | A1 | 7/1994 |
| WO | WO-2009/113920 | A1 | 9/2009 |
| WO | WO 2010/067226 | | 6/2010 |

OTHER PUBLICATIONS

Extended European search report dated Jun. 2, 2016 issued in corresponding European patent application No. 12887020.1 (9 pages).

English-language machine translation of a Chinese Office Action dated Sep. 5, 2016 issued in corresponding Chinese Patent Application No. 201280076629.3 (11 pages).

English language translation of a Russian Decision on Grant dated Jul. 26, 2016 issued in corresponding Russian patent application No. 2015119526 (5 pages).

* cited by examiner

DISPENSING SYSTEM WITH THE MEANS FOR DETECTING LIQUID LEVEL AND A COLLAPSIBLE CONTAINER FOR SUCH A SYSTEM

CROSS-REFERENCE TO PRIOR APPLICATION

This application is a §371 National Stage Application of PCT International Application No. PCT/SE2012/051155 filed Oct. 25, 2012, which is incorporated herein in its entirety.

TECHNICAL FIELD

The present disclosure pertains to a dispensing system including a collapsible container for liquid material, such as e.g. soap. In particular, the present disclosure pertains to a dispensing system including a support structure which is configured for wall attachment of the dispensing system.

TECHNICAL BACKGROUND

In the field of dispensing liquid material, such as soap, from a container, different dispenser system types are known. Liquid dispensers, particularly soap dispensers, of the type which contain a replaceable liquid container are becoming more and more popular. Using a replaceable liquid container allows users and suppliers to rapidly refill an empty dispenser, or to change the type of liquid without having to clean or change the dispenser itself.

The system may either include a container which is rigid or collapsible. While a rigid container maintains its shape upon being emptied, a collapsible container is gradually collapsing, i.e. its inner volume is decreasing as fluid is dispensed therefrom. Collapsible containers are particularly advantageous in view of hygienic considerations, as the integrity of the container is maintained throughout the emptying process, which ensures that no contaminants are introduced thereto, and that any tampering with the content of the container is impossible without visibly damaging the container.

One type of collapsible containers is simple bags, generally formed from some soft plastic material. Bags are generally relatively easy to collapse, and the bag walls would not strive to re-expand after collapse. Hence, the bag walls would not contribute to any negative pressure in the bag.

Another type of collapsible containers is known from e.g. EP 0 072 783 A1 and DE 90 12 878 U1. This type of collapsible containers has at least one relatively rigid wall, towards which the collapse of the other, less rigid walls of the container will be directed. Hence, hereinafter, this type of container is referred to as a semi-rigid collapsible container. A second example of a semi-rigid collapsible container is found in U.S. Pat. No. 5,083,678. This container is made of thermoplastic material and is collapsible from a first configuration to a second configuration during the dispensing of the liquid material.

Irrespective of whether a rigid or collapsible container is used, one of the concerns that is to be considered when designing dispensing systems for liquid materials arises when the container is about to be depleted, requiring it to be replaced by a new, full container. Unlike other dispensers, such as paper dispensers which dispense stacks of folded tissue paper and which can be easily refilled simply by placing additional paper on top of the almost depleted paper stack, such an easy refill is difficult to obtain for a liquid dispenser system.

Known dispensing systems for liquid materials normally have supply bottles, or containers, which are placed upside down in a dispenser to maintain a positive flow of liquid from the outlet or pump, if the outlet is connected to a pump. Several versions of controlling the flow of liquid from the container have been in use during the years. A pump that could be dislodged from the old container and fitted to the new one, has later been replaced with a pump integral in the container, to ease the maintenance work and make sure that no old deposits will clog up an old pump. Often the lever or dosing member to work the pump has been part of the main dispenser body, but other times it has been part of the container itself. It has been found that during usage of such dispensing systems, the replacement of the container should be carried out at the right timing to prevent the container from being fully emptied.

In order to accomplish this, U.S. Pat. No. 4,570,823 suggests a soap solution dispenser having a float body in the reservoir, i.e. container. The float body is provided with at least one indicator flag coupled thereto and the path of movement of the indicator flag extends along a viewing window of the cover. In this manner, the consumer or the user of the dispenser is provided with an indication of the filling state of the soap solution dispenser at a small expense.

US 2008/023487 A1 is another document relating to a dispenser including a collapsible reservoir. The dispenser also contains a tensioning element for stretching the reservoir so as to counteract, or negate, the compression of the reservoir. By applying this stretching, the bulging of the reservoir is pulled inward in a homogenous manner. In this way, the risk of fluid getting trapped in the reservoir is minimised since the risk of having excessive crumpling is decreased. The dispenser further includes an inspection window, which allows the amount of liquid in the reservoir to be seen from outside.

As regards other known arrangements, WO 2009/113920 A1 discloses a bag-in-box type liquid receptacle having an indicating sheet which is attached to the upper wall of the outer container. The indicating sheet is further provided with a flap, running in an opening of the outer container, for visually displaying the liquid level of the inner container. Hence, it is not required to open the outer container and take out the inner container therefrom to determine the amount of liquid which is left in the inner container. However, this type of receptacles is intended for being located on a horizontal surface such as a dining table or kitchen worktop, and is not suitable for use in systems with a reused outer container and exchangeable inserts and is therefore not suitable for being mounted on a wall in restrooms.

Despite the activity in the field, exemplified by the above-cited disclosures, there remains a need for a dispensing system including a collapsible container, which combines high functionality and simplicity with the possibility of identifying when the system is running out of liquid material.

Advantageously, the dispensing system should be suitable for liquid materials such as soap.

SUMMARY

It is desired to improve a dispensing system which includes a collapsible container for liquid material, such as e.g. soap.

Disclosed is a dispensing system including a collapsible container for liquid material, such as e.g. soap. The collapsible container has an outlet for withdrawal of liquid material from the collapsible container during collapse thereof. The collapsible container includes a pump associated with the outlet of the collapsible container such that liquid material can be withdrawn upon activation of a dosing member. The dispensing system has a support structure which is configured for wall attachment of the dispensing system. The support structure includes outlet holder means and contact means for securing the collapsible container to the support structure. The support structure further includes at least one movable follower which is biased towards a collapsing part of the collapsible container. In addition, the support structure is provided with detecting means for detecting the position of the movable follower.

In another embodiment, the support structure could be a part of a dispenser housing for encompassing the collapsible container.

The term "liquid material" refers to e.g. soap, foam, shower/bath gel, detergent, or any mixtures of these materials. The liquid material is typically aqueous. In other words, the term is intended to mean a body of material which is flowable at or about room temperature and pressure, and therefore other liquid materials are conceivable within the scope of the invention. Other liquid materials include e.g. disinfectants, skin-care liquids and even medicaments. Equally, while the description to follow, as a matter of convenience, refers to the dispensing of a soap material, obviously other types of liquids can be conveniently handled, and therefore, the use of this term is not to be construed in any limiting sense. The term is merely to be viewed as an exemplary and desirable field of application for the inventive measures.

The term "collapsible" and variations thereof mean that the volume of the container or the component can be reduced by at least 30% but less than 100%, relative to its volume in its original state, e.g. the state of the container when it is filled with liquid. The difference between a normal container and a collapsible container is that the collapsible container only has one opening for the contents to get to the outside, and no inlet for e.g. air to fill the vacated volume as the contents are let out, and as no air can get in, atmospheric pressure will compress the container as it is flexible.

Collapsible containers are particularly advantageous in view of hygienic considerations, as the integrity of the container is maintained throughout the emptying process, which ensures that no contaminants are introduced therein, and that any tampering with the contents of the container is impossible without visibly damaging the container.

By providing a support structure including at least one movable follower which is biased towards a collapsible part of the collapsible container, as mentioned above, it is meant that a biasing force is imparted to the movable follower that urges it towards a part of the collapsible container, e.g. the exterior surface of the collapsible container. Hence, it is possible for the movable follower to follow the collapse of the container when liquid is being withdrawn from the outlet of the collapsible container. In other words, when liquid material is withdrawn from the dispenser by the user, the amount of liquid material in the collapsible container is reduced causing the container to collapse, whereby the movable follower trails the collapse of the container due to that the movable follower is biased towards the container. By being biased, the movable follower serves as a guiding mechanism and the result of this technical feature is therefore an improved control of the collapse process of the container. In particular embodiments, the movable follower is biased towards a lower portion of the collapsible container, as this normally contains the very last amount of liquid material.

In addition, by means of the provision that the support structure is provided with detecting means for detecting the position of the movable follower, it becomes possible to determine if the dispenser needs to be refilled with a new container of liquid material, e.g. soap. This is achieved since the detecting means is monitoring the deformation of the collapsible container by sensing the position of the movable follower. For instance, when the movable follower has travelled a certain distance by being biased towards the container and due to the collapse of the container, it will finally move into a detectable area of the detecting means such that the detecting means is able to detect the movable follower and signal that the collapsible container needs to be replaced. In this context, the detectable area of the detecting means corresponds to a remaining and critical level of soap in the container. The detectable area can be governed by the characteristics of the detecting means to be used, i.e. type of sensor and detectable substance.

The support structure is configured for wall attachment, such as a vertical surface, to ensure that the dispensing system can be securely attached prior to use so as to avoid any malfunction of the dispensing system. By attaching the dispensing system to a wall or a door, in a vertical direction, the support structure (including the movable follower) is fixated and positioned in a manner which is less dependent on the collapse of the collapsible container than if the dispensing system would have been placed on, for instance, a table surface. As such, the support structure provides the necessary stability to the dispensing system.

Mounting the dispensing system in a vertical direction is the standard to enable the contents to flow out by gravity. Whenever there is a reference to vertical, horizontal, up, down, upper, lower, etc in this application it refers to a direction in a mounted dispenser, fit for its intended use.

Since the support structure is provided with means for securing the collapsible container to the support structure in a reproducible position, and the detecting means is arranged on the support structure, it is ensured that the detecting means maintains its focus on the movable follower upon collapse of the container. Furthermore, it is safeguarded that the detecting of the position of the movable follower is an appropriate reflection of the condition of the collapsible container. Accordingly, by securing the collapsible container to the support structure, the detecting of the position of the movable follower is made from a location which is less dependent on the shape of the collapsible container, i.e. a shape which is transformed upon withdrawal of soap, than if the detecting means would be located on the collapsible container.

In order to provide a dosing of soap when demanded and a liquid-tight closure when the dispensing system is not used, the outlet of the collapsible container is equipped with a pump, either integral or transferred from an old container to a new. These pumps are well known in the art and the exact type is not important for the present invention. The lever or dosing member to work the pump can be part of the main dispenser body, or be part of the container itself.

Examples of directly operatively connected dosing members are a push button or a lever acting on the pump. One example of an indirectly operatively connected dosing member can be a wireless remote receiver such as a handheld unit or stationary unit including a user activated sensor. Other non-exclusive examples of dosing members are sensors that automatically cause dispensing liquid material by a control system upon sensing the presence of a guest in the vicinity or if triggered in any other way, for instance through a user interface of the dispensing system.

In accordance with the disclosed systems, it is possible to meet the desire of high functionality and improved control of the collapsing process of the container, while at the same time being able to improve the recognition of the liquid material level of the container so that a dispensing system which is running dry can be prevented in good time.

Exemplary optional features of the dispensing system are recited in the dependent product claims.

In particular embodiments, the position of the movable follower is a reflection of a remaining amount of liquid material in the collapsible container. Thereby, the detecting means is capable of detecting a liquid material in the collapsible container by detecting the position of the movable follower.

In order to reduce the number of components of the dispensing system to a minimum, the detecting means may be an integral part of the movable follower.

Alternatively, the movable follower and the detecting means may be arranged spaced apart from each other on the support structure. By spaced apart means that the movable follower and the detecting means are separated a distance from each other in at least one direction.

As the liquid level in the container sinks when liquid is drawn from it, the movable follower by its biasing will move into the volume formerly occupied by the liquid, such that the distance between the movable follower and the detecting means will decrease.

There are several different possibilities for detecting the position of the movable follower. For instance, the detecting means is arranged to sense a detectable substance in or on the movable follower. As the detectable substance, different substances are contemplated which are available for detection by a sensor. In particular, it is contemplated adding a metallic substance to the movable follower such that a detecting means sensing a change in the inductive properties of the movable follower can be used. Alternatively, a detecting means sensing a change in the conductive properties of the movable follower can be used. Furthermore, a magnetic substance can be added to the movable follower such that a detecting means sensing a change in the magnetic properties of the movable follower can be used. An electrically conductive substance can be added to the movable follower such that a detecting means sensing a change in the conductive properties of the movable follower can be used. A coloured substance can be added to the movable follower such that a change in colour can be detected by the detecting means. A fluorescent substance can be added to the movable follower such that a change in fluorescence can be detected by the detecting means. A radioactive substance can be added to the movable follower such that the detecting means senses the radiation.

There is also the possibility of adding the detectable substance to an area of the compressible wall of the collapsible container itself, such that the movable follower will press this area towards the detecting means as the container is collapsing.

Accordingly, the detectable substance is chosen from the group of metallic substance, magnetic substance, conductive substance, coloured substance, fluorescent substance, and radioactive substance.

In particular, the detecting means is chosen from the group of inductive sensor, magnetic sensor, capacitive sensor, resistive sensor, conductive sensor, radiation sensor, and angular sensor, such that the movement of the movable follower towards the detecting means and the presence of the detectable substance on, or in, the movable follower triggers the sensor. Other sensors and detectable substance are also contemplated as long as the detectable substance can be applied to the movable follower or the compressible wall of the collapsible container so as to achieve reliable sensing by a sensor.

Expediently, the collapsible container may have at least one rigid portion and at least one compressible portion. The term "compressible" refers to a portion which can be squeezed together or compacted into less space, and is interchangeable to the term "collapsible". In this context, the movable follower is configured to follow the deformation of the compressible portion when the collapsible container is vacated. In this example, the compressible portion will collapse towards the rigid portion. This type of collapsible containers is sometimes defined as a semi-rigid collapsible container, and is suitable for introduction in many existing dispensing systems. One advantage with this type of container is that information may be printed on the rigid portion, such that the information remains clearly visible and undistorted regardless of the state of collapse of the container. Moreover, the particular shape with one half being compressible into the other ensures that emptied containers require particularly little space. Additionally, for some contents, containers having at least one relatively rigid portion may be preferable over bags for a more effective emptying.

In particular embodiments, a portion may be a wall of the container, such that the collapsible container may have at least one rigid longitudinal wall and at least one compressible wall. The movable follower is then configured to follow the deformation of the compressible wall when the collapsible container is evacuated.

In particular embodiments, the rigid portion of the collapsible container is supported by the support structure. In this manner, the support structure provides stability to the collapsible container. Then the collapsible container will during each emptying cycle be in the same relative position to the support structure. This will also maintain the precision of the measurement, especially when the detectable substance is added to the wall of the collapsible container while the detecting means always is positioned on the support structure.

In certain embodiments, the movable follower may be biased towards at least a part of the exterior surface of the collapsible container such that the movable follower influences the deformation of the collapsible container. Since the movable follower influences, i.e. guides and shapes, the deformation, it becomes possible to actively form the collapsible container. Hence, a dispensing system is provided with an even more improved control of the collapse process of the container. In order to provide a movable follower which is sufficiently biased towards the collapsible container, a balance should be kept between the ability to control the collapse of the container and the risk of creating an undesired deformation of the collapsible container, i.e. to avoid that the movable follower itself, due to a too high biasing force, provides an additional undesired deformation of the collapsible container.

There are several different possibilities to provide a movable follower which is sufficiently biased towards a collapsing part of the collapsible container. For example, the movable follower may be biased by weight of gravity. In certain embodiments, the support structure may be provided with guiding railings for the movable follower. Thereby, the guiding railings are capable of guiding the movable follower from an upper position to a lower position, in the vertical direction, such that the movable follower influences the deformation of the collapsible container by means of gravity.

An alternative way of arranging the movable follower is to use double followers and compress the collapsible container from both sides, between the followers. The movable followers can be biased by gravity or by some appropriate force, i.e. magnetic.

A particular way of biasing the movable follower may be obtained when the movable follower is pivotally attached to the support structure around a pivot axis P, which allows the movable follower to follow the deformation of the collapsible container.

In addition, the movable follower may be provided in the form of a plate pivotally connected to a lever, whereby the lever is pivotally attached to the support structure around a pivot axis, which allows the plate to follow and influence the deformation of the collapsible container. In this manner, the function of the movable follower is improved such that the movement of the movable follower becomes smoother.

The plate is arranged to extend over some length of the collapsible container, in the vertical direction. It also extends over some width. The length could be 20-40 mm and the width could be 15-40 mm. This will create a distributed pressure on the collapsible container, such that most of the liquid will be able to, by gravity, flow down inside the container and pass the area of the plate, before the plate will come near enough the detecting means to be detected. Thus is ensured an economical use of the system, where most of the soap will be used up before a used collapsible container is exchanged by a new one.

In order to achieve a movable follower which is positively biased towards the collapsible container, the movable follower may be biased by means of a spring. For example, the movable follower may be biased towards a compressible part of the collapsible container by means of a spring, which allows the movable follower to follow and influence the deformation of the collapsible container. The spring renders the movable follower spring-tensioned, or spring-biased, and by this technical feature, it becomes possible to provide a movable follower which is acting on at least a part of the exterior surface of the collapsible container in a homogenous manner. The spring-biased movable follower is also independent of the filling state of the collapsible container.

Another possibility for biasing the movable follower resides in providing it with a telescopic tension. For example, the movable follower is biased towards a collapsing part of the collapsible container by means of a telescopic tension, which allows the movable follower to follow the deformation of the collapsible container. The movable follower may for instance be attached to the support structure by means of a telescopic tension system. By telescopic tension system is meant a technical solution with a compressed spring that will exert a force upon the movable follower, which in this case will move perpendicularly from the wall part of the support structure towards the collapsible container and the detecting means. The spring should have a low enough force over a long enough distance to press on the collapsible container in the correct way.

Advantageously, the area containing the detectable substance on or at the movable follower may be detectable through the collapsible container when the container is substantially collapsed, i.e. when the movable follower is proximate to the detecting means. In this context, the term "substantially collapsed" means a state of the container where the container is reduced in volume by at least 90% relative to its volume in its original state.

In other embodiments, the area containing the detectable substance on or at the movable follower may be detectable by the detecting means from a distance D of less than 15 mm. Or, the detectable substance may be detectable by the detecting means from a distance D of less than 10 mm. Or, the detectable substance may be detectable by the detecting means from a distance D of less than 5 mm. By the distance D is meant the straight distance between the detecting means and the detectable substance. Normally, it is the distance which is measured between the surface of the detecting means, which is facing the movable follower, and the surface of the area containing the detectable substance on or at the movable follower, which is facing the detecting means. It is therefore typical that a part of the collapsible container is located between those surfaces.

The dispensing system may further include alert indicating means for indicating the filling state of the collapsible container, whereby the alert indicating means is activated in response to the detection of the movable follower by the detecting means. The alert indicating means can be an integral part of the movable follower. Alternatively, the alert indicating means may be an integral part of the detecting means. It is also possible that the alert indicating means may be a separate part of the dispensing system which is operatively connected to the detecting means. The alert indicating means can be configured to alert the user on the filling state of the collapsible container. In addition, or alternatively, the alert indicating means can be configured to trigger actions to alert the service personnel of the upcoming depletion of the collapsible container, e.g. to alert the service personnel in a remote location. One exemplary alert indicating means is a visual alert, such as a change in colour of the alert indicating means. Therefore, when the alert indicating means is an integral part of the detecting means, a change in colour of the detecting means may constitute an appropriate alert indicating means. Other non-exclusive examples of suitable alert indicating means are components that can provide an audible alert, a vibrational alert or a verbal alert.

It is advantageous to use a control system to control the timing of the appropriate signals sent out by the sensor, and handle the detection by the sensor and the alert indicating means. The alert indicating means can be situated on the dispenser cover to be seen when a person is in the vicinity of the dispenser. It is also possible to concentrate all the alert indicating means to a central area covering one or more dispensers in one or more washrooms, but still near the actual dispensers, so a caretaker quickly can get an overview of several dispensers in one, or more, washrooms.

It is also conceivable to have the control system send remote signals, by radio or by net, to another more remote location, e.g. to indicate to caretakers that the collapsible container should be exchanged for a new one at the next service round.

The dispenser normally needs to be supplied with electrical power to the control system, the detecting means and the alert indicating means. This may be supplied by normal electric mains, or to get more flexibility in placing the dispenser, by replaceable batteries. By using a low sensor timing frequency, the power consumption could be very low.

In other embodiments is a collapsible container for liquid material suitable to be used in a dispensing system for liquid material, wherein the detectable substance is fastened to the outside of the compressible portion of the collapsible container where it will be in contact with the movable follower when the movable follower presses against the collapsible container. This will ensure that there always is a fresh amount of detectable substance.

BRIEF DESCRIPTION OF THE DRAWINGS

Embodiments of the invention will be described in more detail with reference to the appended schematic drawings, in which.

DETAILED DESCRIPTION OF THE PREFERRED EMBODIMENTS

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions will not necessarily be described in detail for brevity and/or clarity.

Figure 1:
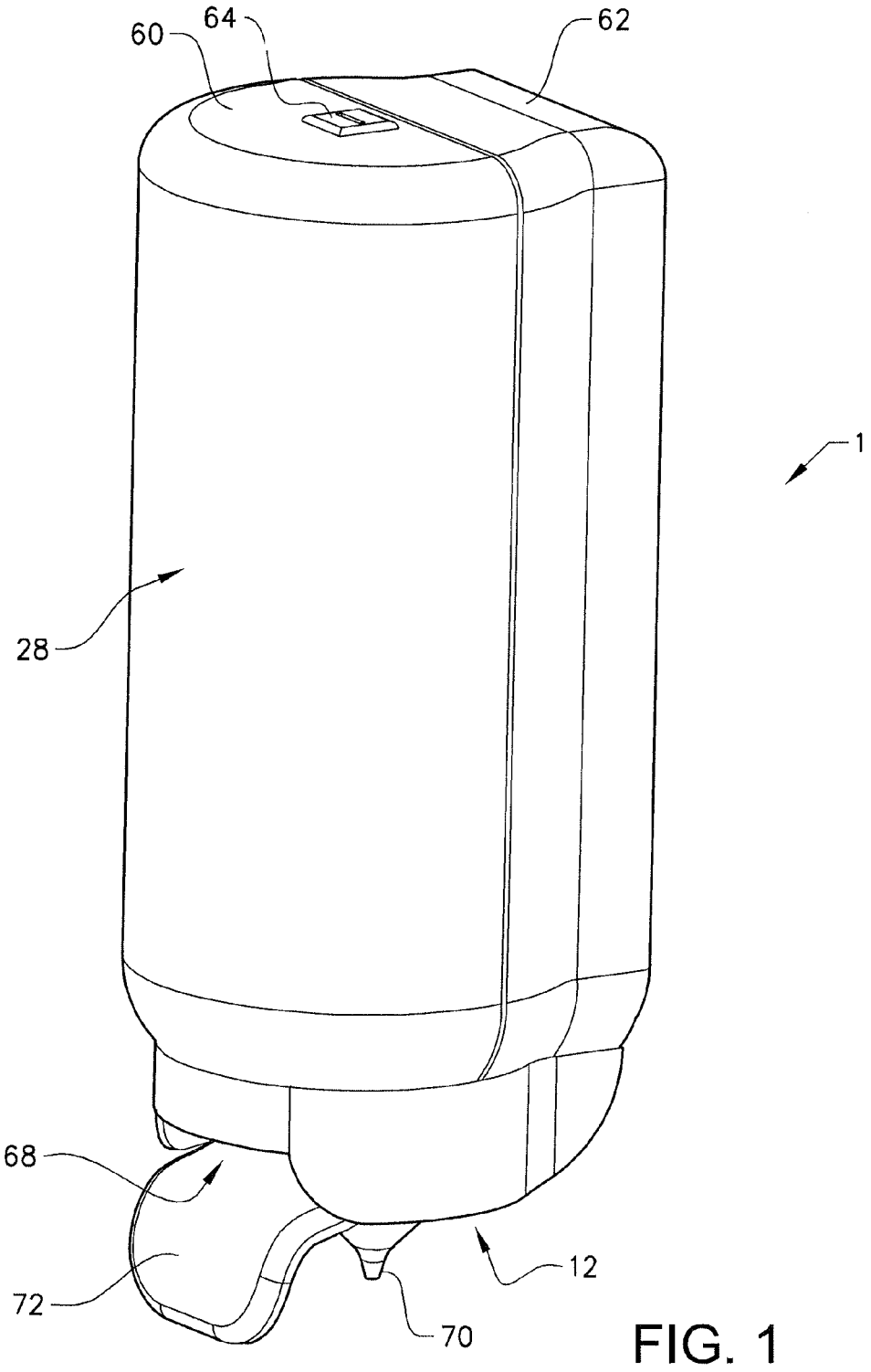
FIG. 1 shows the combination of a dispensing system and a collapsible container of an embodiment of the present invention.
Figure 2:
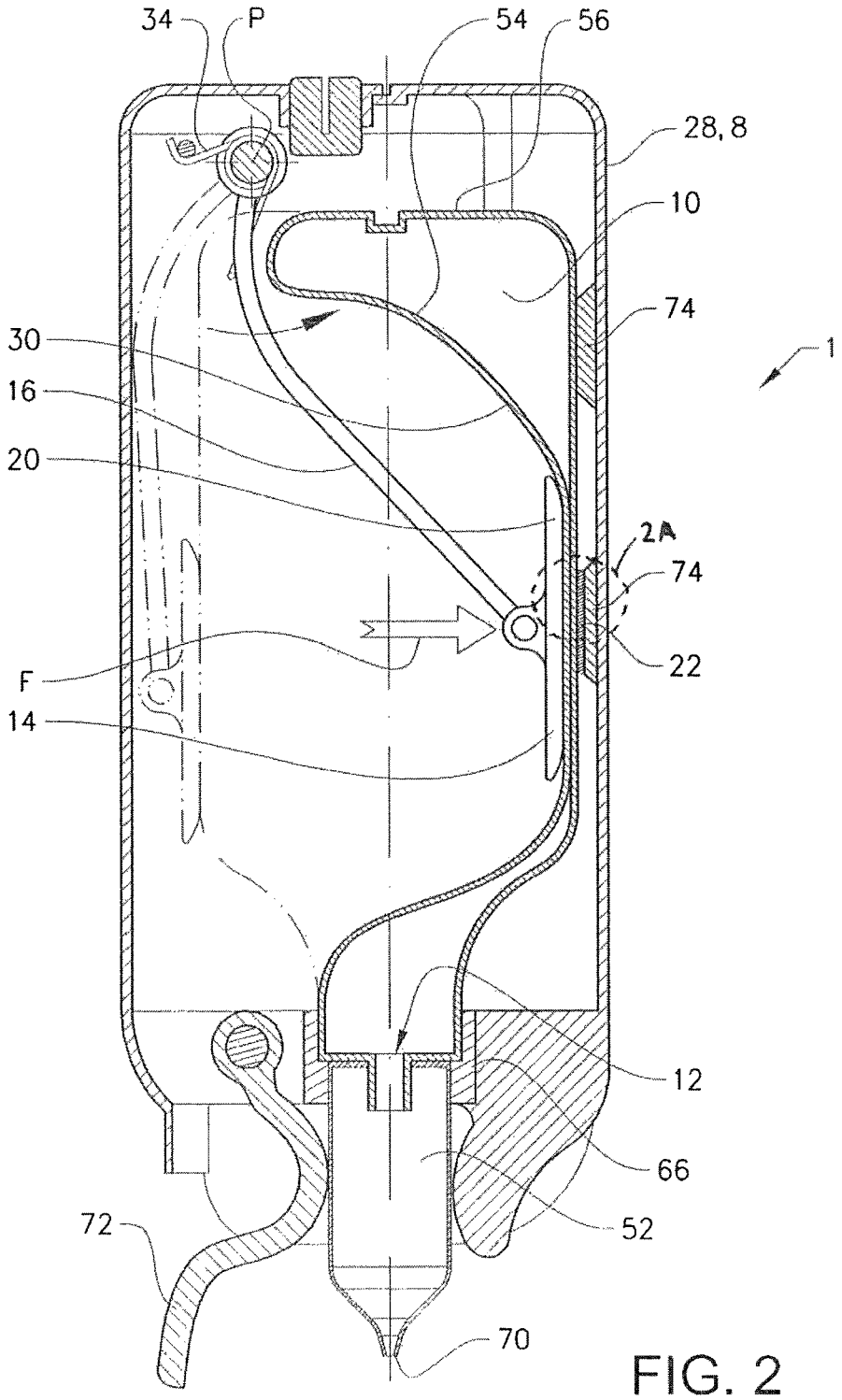
FIG. 2 is a cross-sectional view through the dispenser and collapsible container, which shows a first embodiment of the dispensing system of the present invention when the collapsible container is collapsed, and also indicates the uncollapsed state.
Figure 2A:
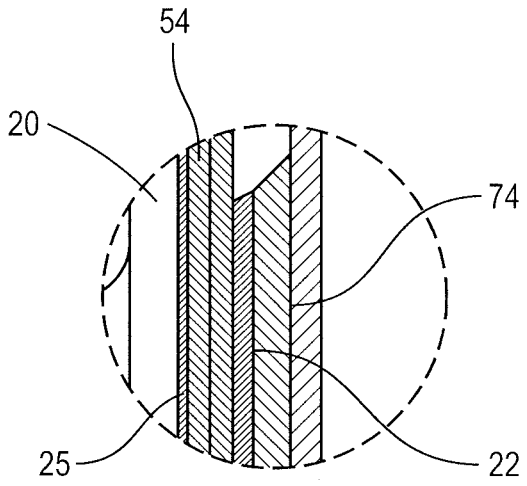
FIG. 2A is a zoomed-in view of portion 2A of a dispenser and collapsible container according to an example embodiment of FIG. 2.

FIGS. 1-2A illustrate a dispensing system 1 for liquid according to example embodiments. The dispensing system 1 is adapted to contain a collapsible container 10 for liquid material such as soap. The collapsible container 10 is designed to securely and safely store and transport liquid prior to use, and to be inserted into a dispensing system 1, in which dispensing takes place from the bottom of the dispensing system 1. The dispensing system illustrated includes a support structure 8 for holding the collapsible container 10. The support structure 8 may be a simple structure, e.g. a holder or a handle. If the support structure is a handle, the handle is suitable for gripping around at least a part of the collapsible container. However, as seen in FIG. 2, the support structure 8 is an integral part of a dispensing housing 28 which is suitable for encompassing the collapsible container 10. Hence, throughout this description, either dispensing housing 28 or support structure 8 is used to denote a component which is suitable for holding the collapsible container 10.

Conventionally, the dispensing system 1 is placed in a location where the soap is used, e.g. a restrooms, close to hand washbasins or sinks in public establishments, or hospital, industrial or kitchen premises. It may also be used to dispense foam.

The dispensing system illustrated is configured for mounting on a vertical surface (e.g. a wall or a door), and liquid is dispensed from the lower end of the dispensing system 1. The support structure 8 is configured for wall attachment to ensure that the dispensing system can be securely attached prior to use so as to avoid any malfunction of the dispensing system. By attaching the dispensing system to a wall or a door, in a vertical direction, the support structure (including the movable follower) is fixated and positioned in a manner which is less dependent on the collapse of the collapsible container than if the dispensing system would have been placed on, for instance, a table surface. As such, the support structure 8 provides the necessary stability to the dispensing system.

The dispensing system 1 may therefore include mounting means for mounting the dispensing system 1 on the vertical surface. The dispensing system 1 can be mounted to the wall by means of screws or bolts, and may therefore be provided with attachment holes in their rear walls to this extent. The dispensing system 1 may also be mounted to the wall by means of a suction unit disposed on the outside of the rear wall of the dispenser housing 28. Other designs are also possible within the scope of the present invention which enables the dispensing system 1 to be attached to a vertical surface.

The dispensing housing 28 shown in FIG. 1 includes a first portion 60 and a second portion 62. The first and second portions 60, 62 are hinged against one another, and fastened via a lock 64. Other fastening means between the first and second portions 60, 62 are conceivable. In the illustrated embodiment, the first portion 60 includes the front side of the dispensing housing 28, while the second portion 62 includes the rear side of the housing 28, and the two portions are hinged towards the bottom 68 of the housing 28, although other designs are also possible within the scope of the present invention. The two portions may further be pivoted about an essentially horizontal axis from the illustrated closed position to an open position, in which an access opening provides access to an interior of the housing 28.

The dispensing housing 28 may be made of any suitable materials, e.g. plastic or metal. As previously mentioned above, the housing 28 holds the collapsible container 10 in place, and protects it from damage and theft. A dispensing housing 28 is not entirely necessary, however, and the collapsible container 10 may be held in place in the dispensing system 1 solely by the support structure 8, which for instance can be elastic straps or mechanical engagement between the collapsible container 10 and the dispensing system 1.

In one embodiment of the invention illustrated by FIG. 1 the user activates dispensing of soap by pushing the dosing member 72 which is operatively connected to the pump 52 of the collapsible container 10.

Inside the dispensing system 1 a collapsible container 10 for a liquid material such as soap is arranged. The collapsible container 10 is that portion of the dispensing system 1 in which soap is stored. Hence, the collapsible container 10 is capable of holding a liquid which is to be dispensed from the dispensing system 1. In FIG. 2, the collapsible container 10 is shown as having a generally cylindrical form, but other three-dimensional forms are possible (e.g. cuboid). The collapsible container 10 is hollow.

The main part of the collapsible container 10 may advantageously be made from a conformable material, e.g. rubber, plastics or polymer material, which tolerates the liquid contained, without degradation of the liquid or the collapsible container. Suitable plastic materials are e.g. a polypropylene- or polyethylene-based material. It is particularly advantageous if the pump 52 is formed from materials of the same type as the materials in the main part of the collapsible container, if used together with the container, such that the entire collapsible container 10 may be disposed and recycled as one single unit. The main part of the collapsible container 10 may advantageously be blow-moulded.

The collapsible container 10 may include two portions 54, 56. One portion 54 is softer than the other, and collapses as liquid is dispensed from the container 10. In other words, the collapsible container 10 is advantageously of the semi-rigid type, having a relatively rigid portion 56 and a collapsing (compressible) portion 54. Generally, the difference in rigidity of the portions may be obtained by providing the portions with walls having different material thicknesses, the rigid portion having a larger wall thickness than the collapsing (compressible) portion. However, the collapsible container may also be made of two parts of different material.

The illustrated collapsible container 10 is divided in the vertical direction, such that the rigid portion 56 approximately forms one vertical half of the container, and the collapsing (compressible) portion 54 approximately forms the other vertical half. As can be seen in FIG. 2, the collapsing portion 54 will collapse towards, or into, the rigid portion 56 during emptying of the container 10. During collapse, the rigid portion provides sufficient support for maintaining a controlled position of the container in e.g. a dispenser. This construction avoids the problem with build-up of vacuum within the container 10, while maintaining a portion of the collapsible container 10 which is rigid, suitably for displaying information thereon. This is particularly advantageous when information is to be printed on the container, and it is desired that the information is visible through e.g. a window in the dispenser throughout the emptying process. Since the information is printed on the rigid portion 56, the information remains clearly visible and undistorted regardless of the state of collapse of the container.

As shown in FIG. 2, the rigid portion 56 of the collapsible container 10 is supported by the support structure 8 at support means 74. In this manner, the support structure 8 provides stability to the collapsible container 10.

The collapsible container 10 includes an outlet 12 connected to the pump 52 for withdrawal of liquid material from the container during collapse thereof. The outlet 12 can be formed as extending from an end wall of the rigid portion of the collapsible container. The outlet 12 forming part of the rigid portion to rest upon the outlet holder 66 is advantageous from a manufacturing point of view and ensures that the structure and positioning of the outlet is stable. As mentioned above, the pump 52 is operatively connected to the dosing member 72 of the support structure 8 such that soap can be withdrawn upon activation of the dosing member 72.

The pump 12 has an inlet, an outlet, and a recovery means. As with most pumps, the pump has an idle stage, a discharging stage, and a recharging stage. In the idle stage, the pump mechanism is at rest and provides a fluid-tight seal. In the discharging stage a shot of the fluid is expelled from the pump 52 through the dispensing outlet 70. The recovery means allows the pump 52 to return to the idle stage from the end of the discharging stage via the recharging stage when a shot of the fluid is drawn into the pump 52. One example of a suitable pump is shown in WO2010067226. Another example of a pump suitable for foam is shown in WO2011133077. However, since the constructional features of a pump and its operative connection to a dispenser are well known in the art, they will not be described in further detail. In embodiments of the present invention, the pump can be replaced with a simple pump valve in order to provide a fluid-tight connection between the collapsible container and the dispensing outlet 70.

Moreover, the support structure 8 includes outlet holder means 66 for securing the outlet 12 of the collapsible container 10 to the support structure 8. The outlet holder means 66 can be arranged at the bottom of the support structure 8, as illustrated in FIG. 2. This will ensure a fixed and secure positioning for the entire collapsible container, in those cases the outlet is part of the rigid part of the collapsible container 10.

Figure 4:
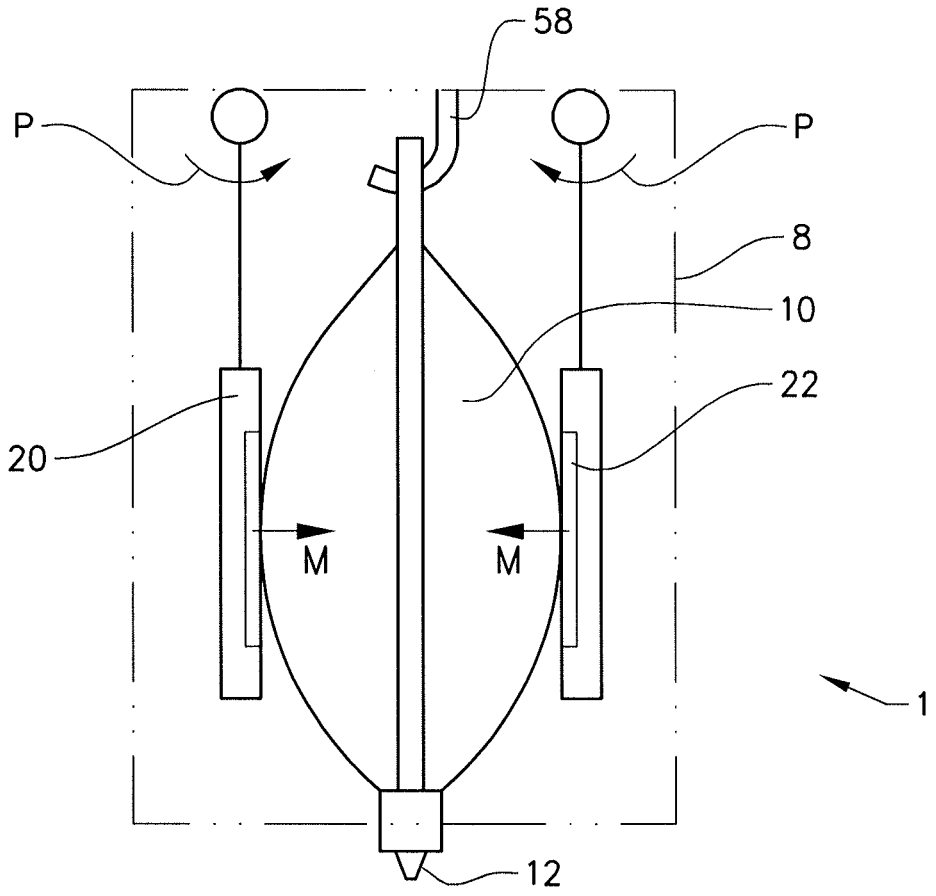
FIG. 4 is a cross-sectional view of the functional parts of the dispensing system according to a third embodiment of the present invention.
Figure 5:
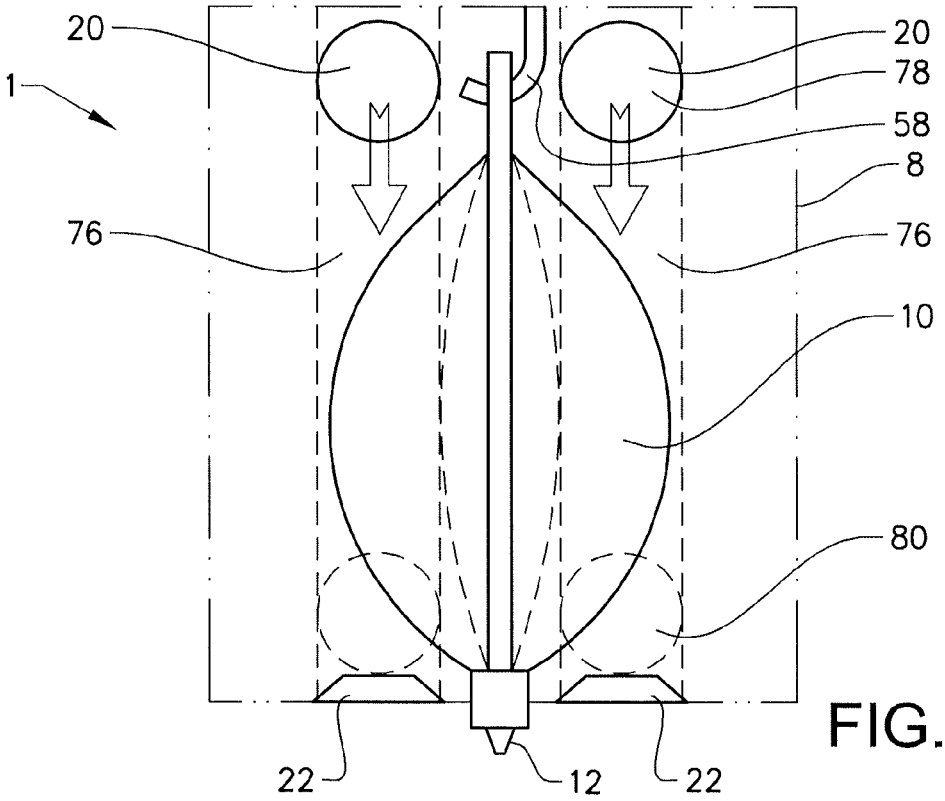
FIG. 5 is a cross-sectional view of the functional parts of the dispensing system according to a fourth embodiment of the present invention.

Top holder means 58 can be arranged at the top of the support structure 8, as illustrated in FIGS. 4 and 5.

Contact means 74 is arranged on any of the side portions of the support structure 8, as illustrated in e.g. FIG. 2. Thus the collapsible container 10 can be supported, not to move in a sidewise direction. This will be further explained in view of the embodiments below.

As illustrated in FIG. 2, the support structure 8 includes a movable follower 20. The movable follower 20 is biased towards a collapsing part of the collapsible container 10, e.g. the collapsible portion 54 as seen in FIG. 2.

By using a biased movable follower 20 in accordance with embodiments of the present invention, it is meant that a biasing force is imparted to the movable follower which urges the movable follower towards a part of the collapsible container 10. As shown in FIG. 2, this part of the collapsible container can be the exterior surface 30 of the collapsible container. It is therefore possible for the movable follower 20 to follow the collapse of the container 10 when soap is being withdrawn from the collapsible container 10. In other words, each time the user withdraws soap from the dispensing system 1, the amount of soap in the collapsible container 10 is reduced which causes the container to collapse a little. During this collapsing process, the movable follower 20 trails the collapse of the container 10 due to that the movable follower 20 is biased towards the container 10. That is, the movable follower 20 moves from the dashed position in FIG. 2 to the full-lined position in FIG. 2. By being biased, the movable follower serves as a guiding mechanism and the result of this technical feature is therefore an improved control of the collapse process of the container.

Hence, in the dashed lines in FIG. 2, the movable follower 20 is shown in its original position, i.e. when the collapsible container 10 is filled with soap. When dispensing a portion of soap from the collapsible container 10, the container deforms due to its properties and construction, as mentioned above. In other words, the collapsing portion of the container 10 will collapse into the rigid portion of the container 10, and when the container 10 is emptied, or nearly emptied, the collapsible container 10 may take the shape as can be seen in the full lines in FIG. 2. During collapse, the movable follower 20 is biased towards the exterior surface 30 of the container 10, and follows the deformation of the collapsible container 10. In this manner, the movable follower 20 trails the collapse of the container 10 when liquid is being withdrawn from the collapsible container 10.

The position of the movable follower in accordance with the present invention is a reflection of a remaining amount of soap in the collapsible container 10. Thereby, the detecting means 22 is capable of detecting the soap level in the collapsible container 10 by detecting the position of the movable follower 20.

In order to further improve the control of the collapse process of the container 10, the movable follower 20 may be configured to actively form the collapsible container 10. In this alternative embodiment of the present invention, the movable follower 20 is biased towards at least a part of the exterior surface of the collapsible container 10 such that the movable follower 20 influences the deformation of the collapsible container 10. That is, the biasing force which is applied by the movable follower 20 on the collapsible container 10 allows the movable follower to influence, i.e. guide and shape, the collapse process of the container 10. Hence, a dispensing system is provided with an even more improved control of the collapse process of the container.

FIG. 2 shows a dispensing system according to a first embodiment of the present invention in a cross-sectional view. In this embodiment, the movable follower 20 is pivotally attached to the support structure 8, i.e. dispensing housing 28, around the pivot axis P. The movable follower 20 is formed by a plate 14 pivotally connected to a lever 16. Hence, the lever 16 is pivotally attached to the support structure 8, i.e. dispensing housing 28, around a pivot axis P, which allows the movable follower 20 to rotate around the axis P towards the collapsible container 10. In this particular embodiment, the lever 16 is biased by means of the spring 34 to render the movable follower 20 spring-biased towards the container part 54. By this arrangement, it is possible for the lever 16 (or movable follower 20) to follow the deformation of the collapsible container. The movement of the movable follower 20 is smooth and carried out in a homogenous manner, but also independent of the filling state of the collapsible container 10 since the biasing force of the movable follower comes from the spring 34.

The movable follower 20 should be biased towards the lower part of the collapsible container 10. This allows the movable follower 20 to follow the part of the collapsible container 10 which normally contains the very last amount of soap.

In certain embodiments, the movable follower 20 is provided in the form of a plate 14, pivotedly connected to the lever 16 to freely follow the container. The plate 14 is arranged to extend over an area of the collapsible container such that no folds occur in the container wall between the movable follower and the detecting means. No sharp edges or corners should be allowed on the plate, so it will not penetrate the container wall. The area of the plate can of course vary depending on the size of the collapsible container and the liquid to be dispensed, but one non-limiting example is a vertical height of 35 mm and a horizontal width of 15 mm. A normal range is a vertical height of 20-40 mm and a horizontal width of 15-40 mm. The range of dimensions can of course be varied considerably, depending also upon the flexible material used, and the force with which the plate is pressing on the collapsible container.

The movable follower 20 can be biased in many ways besides that the lever 16 can be pivotally attached to the dispensing housing 28 by means of a spring 34. For instance, it is within the scope of the present invention to make use of a tensioned pin in a sleeve or any other suitable means known by the skilled in the art which allows the lever 16, and the movable follower 20, to be rotatable around the pivot axis P, and biased towards the collapsing part 54 of the collapsible container. It is contemplated to use a biased configuration of the movable follower 20, which is sufficient to make sure that the movable follower 20 can rotate reliably and smoothly around the pivot axis P while at the same time provide the required biasing force F such that the movable follower 20 is biased towards the exterior surface 30 of the compressible part 54 of the collapsible container 10. It is also contemplated to use the lever 16 itself as a spring, in which case it should not be allowed to rotate around the pivot axis P, but instead be fastened to the support structure 8 at one end and tensioned against the collapsible container 10 at its other end. Further possibilities of biasing the movable follower will be described below.

In the above embodiment, the term movable follower 20 includes a lever 16 and a plate 14. The plate 14 can be attached to the lever 16 in a pivotable way, such that the plate can maintain a flat and close alignment to the surface 30 of the collapsible container.

However, it is also possible within the scope of the present invention that the movable follower may include further components, e.g. an additional spring. The lever 16 and the plate 14 may be integral components of the support structure 8 or the dispensing housing 28. It is also apparent that the attachment of the movable follower to the support structure, or dispensing housing, does not have to be at the upper part of the housing. The movable follower can for instance be attached to either of the side walls of the dispensing housing or even to the bottom of the dispensing housing. The specific attachment of the movable follower depends on the shape of the collapsible container and the space available between the dispenser housing and the collapsible container.

As can been seen from the embodiment shown in FIG. 2, and as explained above, the collapsible container 10 is defined by one rigid portion 56 and one compressible portion 54. The movable follower 20 is in this context configured to follow the deformation of the compressible portion 54 when the collapsible container 10 is evacuated. Further, the rigid portion 56 of the collapsible container 10 is supported by the support structure 8. The rigid portion 56 of the collapsible container 10 is fastened to the support structure 8 by the illustrated outlet holder means 66 and contact means 74 such that the container 10 is securely attached to the support structure 8.

The support structure 8 further includes detecting means 22 for detecting the position of the movable follower 20. In the embodiment as illustrated in FIG. 2, the detecting means 22 is arranged spaced apart from the movable follower 20 by a distance in the horizontal direction. In particular, the detecting means is located in, or proximate, one of the contact means 74, which is a part of the support structure 8 in the illustrated dispensing system 1.

However, in some embodiments, it is also possible that the detecting means 22 may be an integral part of the movable follower 20.

By arranging the detecting means 22 in the support structure 8, it becomes possible to determine if the dispensing system 1 needs to be refilled with a new container of liquid material, e.g. soap. This is achieved since the detecting means 22 monitors the deformation of the collapsible container by sensing the position of the movable follower 20. As illustrated by FIG. 2, the movable follower 20 travels from a first state, the dashed lines in FIG. 2, to a second state, the full lines in FIG. 2, i.e. a certain distance, by being biased towards the container 10 during the collapse process of the container. Finally, the movable follower 20 has travelled into a detectable area of the detecting means 22 such that the detecting means 22 is able to detect the movable follower 20. The detecting means 22 is arranged to sense a detectable substance in the movable follower 20. In a particular embodiment, the plate 14 of the movable follower 20 is made of metal, i.e. the detectable substance is a metallic substance, and the detecting means 22 is an inductive sensor, such that the detecting means 22 senses a change in the inductive properties of the movable follower. When the movable follower 20 is detected by the detecting means 22, the detecting means 22 signals by appropriate alert indicating means (not shown) that the collapsible container 10 needs to be replaced. In this context, the detectable area of the detecting means corresponds to a remaining and critical level of soap in the container 10. The detectable area can for instance be a predetermined detectable area or a detectable area governed by the detecting means to be used.

It is advantageous for any embodiment of the invention to position the detecting means 22 fairly low down to ensure that not too much of the soap is left in the collapsible container 10 when the movable follower 20 enters the detectable area.

When the detecting means 22 is triggered by the nearness of the movable follower 20, the sensor used for that particular detecting means could in known ways use a control system to send an electrical signal, which could be used for a plurality of different alert indicating means.

The sensor is connected to a control system (not shown) that will control the timing of the appropriate signals sent out by the sensor, if the sensor is of the active type. If the movable follower, and with it the detectable substance, has come into the detectable area the sensor will send back a signal to the control system. Passive sensors don't need to send signals, they will just wait for the appropriate 'message' from the detectable substance (e.g. magnetic resonance sensors, etc).

The control system may then handle an answer signal from the sensor in a suitable manner to use it for triggering the alert indicating means.

Examples of alert indicating means handled by the control system are coloured lamps turned on or blinking, messages like 'please refill' lighting up, covering lids being removed from text messages, pictographs or signal (e.g. red) areas. These can be situated on the dispenser cover to be seen when a person is in the vicinity of the dispenser. It is also conceived to concentrate all the alert indicating means to a central area covering one or more dispensers in one or more washrooms, but still near the actual dispensers, so a caretaker quickly can get an overview of several dispensers in one, or more, washrooms.

It is also conceivable to have the control system send remote signals, by radio or by net, to another more remote location, e.g. to indicate to caretakers that the collapsible container 10 should be exchanged for a new one at the next service round.

The dispenser normally needs to be supplied with electrical power to the control system, the detecting means and the alert indicating means. This may be supplied by normal electric mains, or to get more flexibility in placing the dispenser, by replaceable batteries.

An active sensor functions by sending out signals in a timed sequence, to check if there will be a positive response, and is often used for dispensing i.e. a drying towel to a user approaching a towel dispenser. In such a case, the response time should be very short, not to let a user wait for the towel.

In the soap dispenser case, the soap level is sinking very slowly and the timing frequency for a sensor can be very low, i.e. once every ten minutes, or every hour, or once a day—for example before the caretaker starts the maintenance round. This makes it possible to adjust the control system in a way to have a very low power consumption, for batteries to last for a long time.

The detectable substance that is provided to either the wall of the collapsible container or the movable follower 20 is a detectable substance which can be replaced with a wide range of substances depending on the selected type of sensor.

As the detectable substance, different substances are contemplated which are available for detection by a sensor. In particular, the detectable substance is chosen from the group of metallic substance, magnetic substance, conductive substance, coloured substance, fluorescent substance, and radioactive substance.

Other combinations of sensors and detectable substances are also contemplated as long as the detectable substance can be applied to the movable follower (or the detectable substance added to the wall of the collapsible container) so as to achieve reliable sensing by a sensor.

In one example, the movable follower 20 may be detectable through the collapsible container 10 when the container is substantially collapsed, i.e. when the movable follower 20 is in close vicinity of the detecting means 22. This state of the container is illustrated by the full lines in FIG. 2. In this context, the term "substantially collapsed" means a state of the container where the container is reduced in volume by at least 90% relative to its volume in its original state.

Moreover, it is possible to make an appropriate configuration of the detecting means such that the movable follower is detectable by the detecting means from a distance D of less than 15 mm, from less than 10 mm, or from less than 5 mm. The distance D is the closest distance between the detecting means 22 and the detectable substance applied to either the wall of the collapsible container or the movable follower 20. Normally, it is the distance which is measured between the surface of the detecting means 22, which is facing the movable follower, and the surface of the movable follower 20, which is facing the detecting means.

As previously explained, the collapsible container 10 is formed by one compressible portion 54, which collapses towards, and into, the rigid portion 56 as liquid is dispensed from the container 10. During this process, the detecting means 22 will detect the position of the detectable substance and ultimately alert by appropriate alert means (not shown) if the container needs to be replaced.

Accordingly, the dispensing system 1 may further include alert indicating means for indicating the filling state of the collapsible container 10. The alert indicating means is activated in response to the detection of the movable follower 20 by the detecting means 22. The alert indicating means may be provided as an integral part of the detecting means in the form of a visual alert, such that a change in colour of the alert indicating means occurs when the movable follower 20 is detected by the detecting means 22. Thus, by using a transparent cover of the dispensing system 1, the alert indicating means is visible to the user from the outside of the dispensing system 1. Likewise, the alert indicating means may be an integral part of the movable follower 20. Alternatively, the alert indicating means may be a separate part of the dispensing system 1 which is operatively connected to the detecting means 22. For example, the alert indicating means may be configured to alert the user on the filling state of the collapsible container 10. Non-exclusive examples of suitable alert indicating means, besides a visual alert, are components that can provide an audible alert, a vibrational alert or a verbal alert.

As previously mentioned above, the support structure 8 is also provided with lower holding means 66 and contact means 74 for securing the collapsible container 10 to the support structure 8. In this context, the detecting means 22 is arranged on the support structure 8 to ensure that the detecting means 22 maintains its focus on the movable follower 20 upon collapse of the container 10. Furthermore, by securing the above relationship between the components, it is safeguarded that the reading of the position of the movable follower 20 is an appropriate reflection of the condition of the collapsible container 10.

Embodiments of the present invention provide several additional possibilities for biasing the movable follower towards the support structure of the dispensing system.

Some of these possibilities will now be discussed with reference to the embodiments shown in FIGS. 3 to 6.

Figure 3:
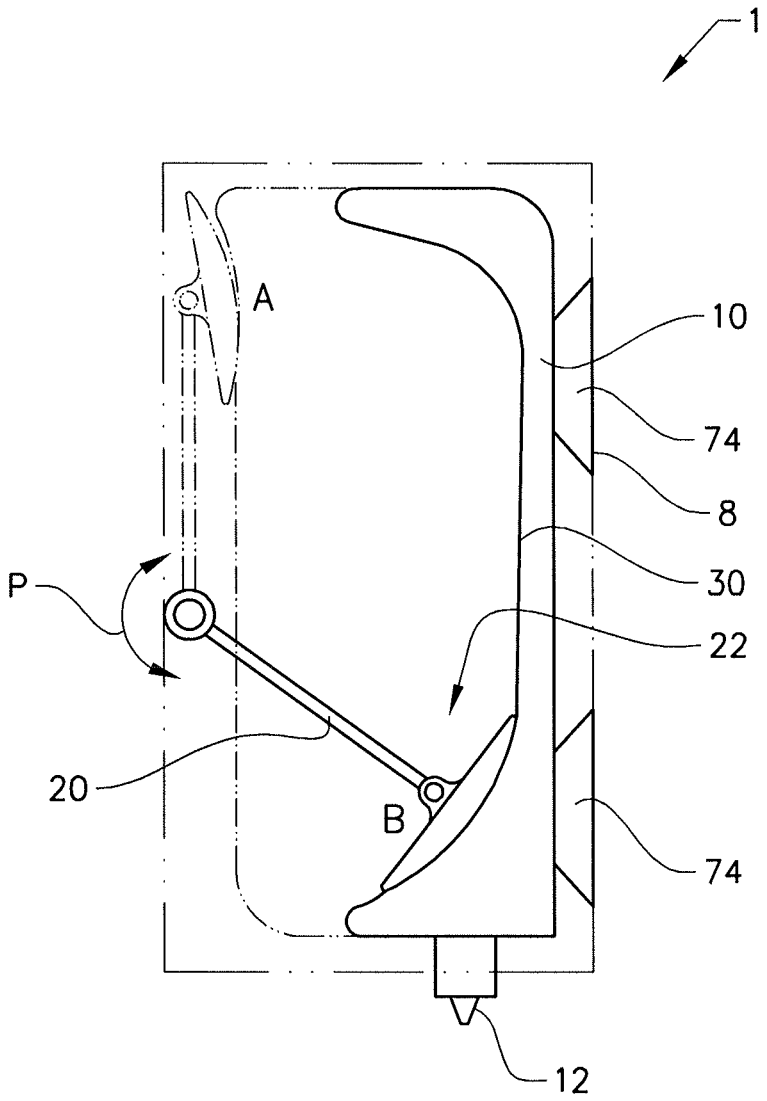
FIG. 3 is a cross-sectional view of the functional parts of the dispensing system according to a second embodiment of the present invention.

FIG. 3 shows a dispensing system according to a second embodiment of the present invention in a cross-sectional view. In this embodiment, the movable follower 20 is pivotally attached to the support structure 8 around the pivot axis P. By this configuration of the movable follower 20, it is possible for the movable follower 20 to follow the deformation of the collapsible container 10. This is achieved since the movable follower 20 is biased towards the external surface 30 of the collapsible container 10 by means of a spring (not shown) such that the movable follower can rotate around the pivot axis P in a clock-wise direction, as shown by the arrow in FIG. 3. For this particular embodiment, the detecting means 22 is an integral part of the movable follower 20. Due to the detecting means 22 on the movable follower 20, it is possible to recognize if the collapsible container 10 is running dry. The detecting means 22 is provided by means of an angle sensor, which is configured to measure the angular position of the movable follower 20. The angular sensor is configured such that a certain angle corresponds to a certain state of the collapsible container 10, and consequently a certain level of soap. The function of the movable follower 20 can be clearly understood by explaining its movement when soap is withdrawn from the dispensing system 1 by the user, which results in a gradual collapse of the collapsible container 10, i.e. its inner volume is decreasing as soap is dispensed therefrom. As such, when the collapsible container 10 collapses from its original state to an empty state, the movable follower 20 moves from a first upper position (A) to a second lower position (B), as shown in FIG. 3. By measuring the angle of the movement of the movable follower 20, the detecting means 22 provides a suitable indication to the user when the second position B is reached by the movable follower 20, which corresponds to an empty state of the collapsible container 10. Hence, it is possible to monitor the soap level of the collapsible container so that a dispensing system which is running dry is recognized in good time.

It might be advantageous, if the collapsible container 10 is fairly long and narrow, to arrange the lever arm of the movable follower to be telescopic, such that it can be more extended when it is in the upper or lower positions, than in the middle position, as seen in FIG. 3. This will ensure a smooth and exact following of the liquid level.

FIG. 4 shows a dispensing system according to a third embodiment of the present invention, in a cross-sectional view. In this embodiment, the movable follower 20 is pivotally attached to the support structure 8 around the pivot axis P in a similar manner as explained above for FIG. 2. Besides the features as explained for FIG. 2, this embodiment includes detecting means 22 which are arranged opposite the movable follower 20, in the horizontal direction, as seen in FIG. 4. The collapsible container 10, which in this embodiment doesn't have a stiff wall but two soft walls that both are flexible, is attached to an upper portion of the support structure 8 by the top holder means 58, and is hanging down from the support structure 8, and also is fastened at the outlet 12 to the outlet holder means 66. The collapsible container 10 is located in between the movable follower 20 and the detecting means 22. By this configuration of the movable follower 20, the movable follower 20 is biased towards a compressible portion of said collapsible container 10, and also towards the detecting means 22 on the other side of the collapsible container 10, as seen in FIG. 4. In this embodiment, the biasing is obtained by using a magnetic substance in either the movable follower 20 or detecting means 22. For instance, the movable follower 20 can be provided with a metallic substance and the detecting means 22 can be provided in the form of a magnetic sensor. The magnetic sensor influences the movable follower 20 such that when the collapsible container 10 is collapsed, the movable follower 20 has travelled towards the detecting means 22 due to the magnetic field between the movable follower 20 and the detecting means 22. The magnetic field is illustrated by the two arrows in FIG. 4, and denoted with an M for magnetic field. The detecting means 22 provides a suitable indication to the user when the movable follower 20 is within a certain distance D from the detecting means 22, which may correspond to certain strength of the magnetic field. As for the embodiment in FIG. 2, the distance D is less than 15 mm, less than 10 mm, or less than 5 mm. Hence, it is possible to monitor the soap level of the collapsible container so that a dispensing system which is running dry is recognized in good time.

FIG. 5 shows a dispensing system according to a fourth embodiment of the present invention, in a cross-sectional view. The collapsible container 10, is attached to an upper portion of the support structure 8 by the top holder means 58, and is hanging down from the support structure 8, and also is fastened at the outlet 12 to the outlet holder means 66. In this embodiment, the movable follower 20 is biased by weight of gravity towards the compressible part of the collapsing container 10, which like in the third embodiment doesn't have a stiff wall but two soft walls that both are flexible. The support structure 8 is provided with two cylindric movable followers 20 and four corresponding guiding railings 76, two guiding railings 76 for each movable follower 20. The movable follower 20 has a large enough weight allowing it to be guided in the vertical direction by gravity. It can be made of metal, rubber, or plastic, etc. Thereby, the guiding railings 76 are capable of guiding the movable follower from an upper position 78 to a lower position 80, in the vertical direction, such that the movable follower 20 influences the deformation of the collapsible container by means of gravity. It is also contemplated to only use one movable follower 20 with two corresponding guiding railings 76 where the backside of the collapsible container should be as flat as possible to get good contact with the cylindric movable follower on its downward path. However, it is considered that a system with two movable followers and four guiding railings is more reliable than a system including only one follower and two guiding railings. In this fourth embodiment, the detecting means 22 is placed at the lower part of the support structure 8 and configured such that the position of the movable follower 20 is detected in order to provide an appropriate indication when the movable follower 20 has travelled to the lower position 80. The lower position 80 is indicative of a collapsible container 10 which is emptied. An emptied collapsible container may take the shape as illustrated by the dashed lines of the oval-shaped container in FIG. 5.

Figure 6:
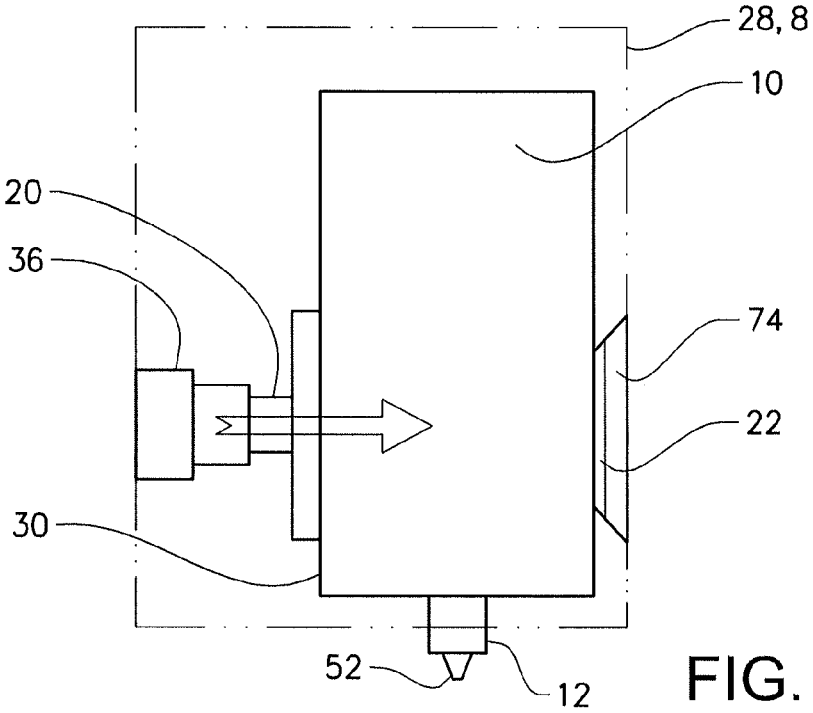
FIG. 6 is a cross-sectional view of the functional parts of the dispensing system according to a fifth embodiment of the present invention.

FIG. 6 shows a dispensing system according to a fifth embodiment of the present invention, in a cross-sectional view. In this embodiment, the movable follower 20 is attached to the support structure 8, or dispensing housing 28, by means of a telescopic tension 36 to render the movable follower 20 biased towards a compressible part of the collapsible container 10. This attachment allows the movable follower 20 to follow the deformation of the collapsible container 10 in a smooth manner.

By telescopic tension system is meant a technical solution with a compressed spring that will exert a force upon the movable follower, which in this case will move perpendicularly from the wall part of the support structure towards the collapsible container and the detecting means. The spring should have a low enough force over a long enough distance to press on the collapsible container in the correct way.

The detecting means 22 is, as shown in FIG. 6, an integral part of the support structure 8 and the contact means 74, and arranged opposite the movable follower 20 in the horizontal direction.

In embodiments of the present invention, and as previously mentioned, it is desired that the movable follower 20 is configured in a manner to make sure that the movable follower 20 can move freely and smoothly against the collapsible container while at the same time provide the required biasing force F such that the movable follower 20 is biased towards the exterior surface 30 of the collapsible container 10. A balance should therefore be kept between the ability to control the collapse of the container and an undesired deformation of the collapsible container, i.e. to avoid that the movable follower itself, due to a too high biasing force, provides an additional undesired deformation of the collapsible container.

Furthermore, it is also envisaged to use combinations of the above attachment configurations, and it will be within the capability of those skilled in the art to make the required adjustments to meet the space limits between the dispensing housing and the collapsible container.

In embodiments of the present invention, the support structure 8 is provided with outlet holder means 66, and in some embodiments with contact means 74 and/or top holder means 58, for securing the collapsible container 10 to the support structure 8. In addition, the detecting means 22 is arranged on the support structure 8 to ensure that the detecting means 22 maintains its focus on the movable follower 20 upon collapse of the container. Furthermore, by securing the above relationship between the above components, it is safeguarded that the reading of the position of the movable follower 20 is an appropriate reflection of the condition of the collapsible container 10.

It is readily understood that numerous alternative embodiments may be envisaged by the skilled person, incorporating one or more of the above-mentioned advantageous features.

In particular embodiments, the movable follower is constructed in a way such that it is feasible for a user or caretaker to take out an emptied collapsible container and reload a new filled one. Normally it will suffice to hold the movable follower against the spring (or other) action working upon it with one hand, take out the used container, and substitute it with a new one, using the other hand.

In other embodiments as shown in FIG. 2A, a collapsible container for liquid material suitable to be used in the inventive dispensing system for liquid material is disclosed, wherein the detectable substance 25 is fastened to the outside of the compressible portion 54 of the collapsible container where it will be in contact with the movable follower 20 when the movable follower presses against the collapsible container.

The use, design and incorporation of further conventional dispensing system components into the above dispensing system will be apparent to the skilled person in the art.

The invention claimed is:

1. A dispensing system comprising a collapsible container for liquid material, wherein the collapsible container has an outlet in the bottom part for withdrawal of said liquid material from the collapsible container during collapse thereof, wherein the collapsible container comprises a pump connected to said outlet of the collapsible container such that said liquid material can be withdrawn upon activation of a dosing member associated with said pump;

a support structure configured for wall attachment of said dispensing system; and a lower holder that secures said collapsible container to said support structure, wherein said support structure further comprises at least one movable follower biased towards a collapsing part of said collapsible container, and a detector that detects the position of the movable follower, and wherein the movable follower and the detector are arranged spaced apart from each other on the support structure, and the distance between the movable follower and the detector decreases as said liquid is drawn from the collapsible container.

2. The dispensing system according to claim 1, wherein the detector is capable of detecting said liquid material in the collapsible container by detecting the position of the movable follower, such that the position of the movable follower is a reflection of a remaining amount of said liquid material in the collapsible container.

3. The dispensing system according to claim 1, wherein at least a part of the collapsible container is positioned between the movable follower and the detector.

4. The dispensing system according to claim 1, wherein at least one element is arranged to support one side of the collapsible container when it is installed in the support structure.

5. The dispensing system according to claim 1, wherein the detector is arranged to detect a detectable substance in or on the movable follower, said detectable substance is chosen from the group consisting of metallic substance, magnetic substance, conductive substance, coloured substance, fluorescent substance, and radioactive substance.

6. The dispensing system according to claim 1, wherein the detector is chosen from the group consisting of inductive sensor, magnetic sensor, capacitive sensor, resistive sensor, conductive sensor, radiation sensor, and angular sensor.

7. The dispensing system according to claim 1, wherein the collapsible container has at least one rigid portion and at least one compressible portion, and said movable follower is configured to follow the deformation of said compressible portion when the collapsible container is evacuated.

8. The dispensing system according to claim 7, wherein the rigid portion of the collapsible container is supported by the element of the support structure arranged to support one side of the collapsible container.

9. The dispensing system according to claim 7, wherein the movable follower is biased towards at least a part of the compressible portion of the collapsible container such that the movable follower may influence the deformation of the collapsible container.

10. The dispensing system according to claim 1, wherein the collapsible container is supported by a top holder fastened at an upper part of the support structure.

11. The dispensing system according to claim 10, wherein the support structure is provided with at least one guiding railing for said movable follower, said guiding railing is capable of guiding the movable follower from an upper position to a lower position, in the vertical direction, such that the movable follower influences the deformation of the collapsible container by gravity.

12. The dispensing system according to claim 1, wherein the movable follower is provided in the form of a plate connected to a lever, whereby the lever is pivotally attached to the support structure around a pivot axis allowing the plate to follow the deformation of the collapsible container.

13. The dispensing system according to claim 1, wherein the movable follower is biased towards a compressible portion of said collapsible container by a spring allowing the movable follower to follow the deformation of the collapsible container.

14. The dispensing system according to claim 1, wherein the movable follower is detectable through the collapsible container when the container is substantially collapsed.

15. The dispensing system according to claim 1, wherein the movable follower is detectable by the detector from a distance of less than 15 mm.

16. The dispensing system according to claim 1, wherein the dispensing system further comprises an alert indicator that indicates the filling state of the collapsible container, wherein the alert indicator is activated in response to the detection of the movable follower by the detector.

17. The dispensing system according to claim 16, wherein the alert indicator is configured to trigger actions to alert the service personnel of the upcoming depletion of the collapsible container.

18. The dispensing system according to claim 1, wherein a detectable substance is added to the outside of a compressible portion of the collapsible container at a position where said detectable substance will be in contact with the movable follower when the movable follower presses against the collapsible container.

19. A dispensing system comprising a collapsible container for liquid material, wherein the collapsible container has an outlet in the bottom part for withdrawal of said liquid material from the collapsible container during collapse thereof, wherein the collapsible container comprises a pump connected to said outlet of the collapsible container such that said liquid material can be withdrawn upon activation of a dosing member associated with said pump;

a support structure configured for wall attachment of said dispensing system; and a lower holder that secures said collapsible container to said su ort structure, wherein said support structure further comprises at least one movable follower biased towards a collapsing part of said collapsible container, and a detector that detects the position of the movable follower, and wherein the movable follower is pivotally attached to the support structure around a pivot axis allowing the movable follower to follow the deformation of the collapsible container.

20. The dispensing system according to claim 19, wherein the detector is an integral part of the movable follower.

21. A collapsible container for liquid material, comprising:

an outlet in a bottom part for withdrawal of the liquid material from the collapsible container during collapse thereof;

a pump connected to said outlet of the collapsible container such that the liquid material can be withdrawn upon activation of a dosing member associated with said pump;

a detectable substance fastened to the outside of a compressible portion of the collapsible container where said detectable substance will be in contact with a movable follower on a support structure when the movable follower presses against the collapsible container upon securing the collapsible container to the support structure.

* * * * *